US008011427B2

(12) United States Patent
Shoyhetman et al.

(10) Patent No.: US 8,011,427 B2
(45) Date of Patent: Sep. 6, 2011

(54) DOUBLE-ACTING JAR

(76) Inventors: Michael Shoyhetman, Edmonton (CA); David Budney, Sherwood Park (CA); Craig Budney, Sherwood Park (CA); Glenn Budney, Sherwood Park (CA)

( * ) Notice: Subject to any disclaimer, the term of this patent is extended or adjusted under 35 U.S.C. 154(b) by 188 days.

(21) Appl. No.: 12/477,452

(22) Filed: Jun. 3, 2009

(65) Prior Publication Data

US 2010/0307739 A1 Dec. 9, 2010

(51) Int. Cl.
*E21B 31/113* (2006.01)

(52) U.S. Cl. ..... 166/178; 175/297

(58) Field of Classification Search ..... 166/178; 175/296, 297

See application file for complete search history.

(56) References Cited

U.S. PATENT DOCUMENTS

| | | | | |
|---|---|---|---|---|
| 5,086,853 | A | 2/1992 | Evans | |
| 5,123,493 | A | 6/1992 | Wenzel | |
| 5,174,393 | A | 12/1992 | Roberts et al. | |
| 5,232,060 | A | 8/1993 | Evans | |
| 5,411,107 | A | 5/1995 | Hailey et al. | |
| 5,447,196 | A | 9/1995 | Roberts | |
| 5,495,902 | A | 3/1996 | Hailey et al. | |
| 5,595,244 | A | 1/1997 | Roberts | |
| 5,595,253 | A | 1/1997 | Martin et al. | |
| 5,647,446 | A | 7/1997 | Wenzel | |
| 5,906,239 | A | 5/1999 | Oettli | |
| 5,931,242 | A | 8/1999 | Oettli | |
| 5,984,028 | A | 11/1999 | Wilson | |
| 6,135,217 | A | 10/2000 | Wilson | |
| 6,202,767 | B1 | 3/2001 | Friis | |
| 6,290,004 | B1 | 9/2001 | Evans | |
| 6,349,767 | B2 | 2/2002 | Gissler | |
| 6,948,560 | B2 | 9/2005 | Marsh | |
| 7,293,614 | B2 | 11/2007 | Rose | |
| 7,299,872 | B2 | 11/2007 | Darnell | |
| 7,753,116 | B2 * | 7/2010 | Budney et al. | 166/178 |

FOREIGN PATENT DOCUMENTS

| | | |
|---|---|---|
| CA | 2072851 | 1/1992 |
| CA | 2113458 | 3/1993 |
| CA | 2105930 | 2/1995 |
| CA | 2179594 | 1/1997 |

* cited by examiner

*Primary Examiner* — William P Neuder

(74) *Attorney, Agent, or Firm* — Frank J. Dykas; Elizabeth H. Schierman; Dykas & Shaver LLP

(57) ABSTRACT

A double-acting jar is disclosed comprising: an outer housing; an inner mandrel at least partially disposed telescopically within the outer housing to define a fluid chamber between the inner mandrel and the outer housing, the fluid chamber containing fluid and being sealed; a valve disposed within the fluid chamber on one of the inner mandrel and the outer housing; the valve having a downhole portion that is movable between a downhole seated position in which the valve seats against the one of the inner mandrel and the outer housing and an unseated position, the downhole portion having a downhole restriction surface; the valve having an uphole portion that is movable between an uphole seated position in which the valve seats against the one of the inner mandrel and the outer housing and an unseated position, the uphole portion having an uphole restriction surface; the other of the outer housing and the inner mandrel having a cooperating restriction surface that cooperates with the downhole restriction surface and the uphole restriction surface to set the double-acting jar for a jar.

19 Claims, 9 Drawing Sheets

DOUBLE-ACTING JAR

TECHNICAL FIELD

This apparatus relates to double-acting jars, in particular to double-acting jars that are actuatable to deliver sequential and repetitive up or down jars to a tubing string.

BACKGROUND

Various components of conventional drill pipe, coiled tubing or other down hole tools may get stuck in the well bore at times. Jars are used in the oilfield industry to deliver jarring blows to a tubing string in order to free a stuck component, such as a stuck section of pipe. Jars are also used in fishing operations, in order to collect and free a object stuck in a downhole well. Under these circumstances, repetitive upjarring or downjarring with a jarring tool can be useful. Double-acting jars exist that are capable of performing this function to a most degree, although many traditional double-acting jars can only perform sequential up and down jars.

Adapting a jar tool to a coiled tubing application presents some challenges to overcome. A coiled tubing operation may involve a continuous pipe or tubing, which is uncoiled from a reel as it is lowered into the well bore, and can be used in drilling or workover applications for example. However, coiled tubing presents a number of working constraints to the design of a tool. First of all, due to the limited strength of the coiled tubing, limited compressive loads can be placed on the tubing by the rig operator. Essentially, this means that downhole tools which require compressive force to operate, such as a jarring tool, must be capable of operating with the limited compressive load capability of coiled tubing. In addition, in coiled tubing applications the overall length of the downhole tool becomes significant since there is limited distance available at the wellhead, for example between the stuffing box and the blowout preventor, to accommodate the bottom hole assembly. A typical bottom hole assembly may include additional tools, for example, a quick disconnect, a sinker bar, a release tool of some type, and an overshot. Thus, the length of the jarring tool itself becomes particularly significant since the entire bottom hole assembly may be required to fit within the limited distance between the stuffing box and blowout preventor to introduce it into a pressurized well. Furthermore, within these confines, the jarring tool may be required to have a large enough internal bore to permit pump-down tools to pass. Thus, the coiled-tubing jarring tool may have a limited overall wall thickness in view of limited outer diameter conditions.

SUMMARY

The jar disclosed herein is capable of being actuated to carry out sequential up and down jars, and repetitive upjars, and repetitive downjars, and is of a simple design.

A double-acting jar is disclosed comprising: an outer housing; an inner mandrel at least partially disposed telescopically within the outer housing to define a fluid chamber between the inner mandrel and the outer housing, the fluid chamber containing fluid and being sealed; a valve disposed within the fluid chamber on one of the inner mandrel and the outer housing; the valve having a downhole portion that is movable between a downhole seated position in which the valve seats against the one of the inner mandrel and the outer housing and an unseated position, the downhole portion having a downhole restriction surface; the valve having an uphole portion that is movable between an uphole seated position in which the valve seats against the one of the inner mandrel and the outer housing and an unseated position, the uphole portion having an uphole restriction surface; the other of the outer housing and the inner mandrel having a cooperating restriction surface that cooperates with the downhole restriction surface and the uphole restriction surface to set the double-acting jar for a jar, the cooperating restriction surface being dimensioned so that, from relative movement of the inner mandrel and the outer housing, the cooperating restriction surface is movable from above to below the valve with a neutral position in which a portion of the cooperating restriction surface is between the downhole restriction surface and the uphole restriction surface; the downhole restriction surface incorporating a first bypass that is configured to allow bypass of fluid in the chamber when the downhole restriction surface and the cooperating restriction surface move past each other during re-setting of the jar to the neutral position; the uphole restriction surface incorporating a second bypass that is configured to allow bypass of fluid in the chamber when the uphole restriction surface and the cooperating restriction surface move past each other during re-setting of the jar to the neutral position; first jarring surfaces on the inner mandrel and outer housing respectively for jarring contact with each other during a jar in a downhole direction; and second jarring surfaces on the inner mandrel and outer housing respectively for jarring contact with each other during a jar in an uphole direction.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

In FIG. 7A, dashed lines are used to indicate the perimeters of the downhole and uphole restriction surfaces.

DETAILED DESCRIPTION

Immaterial modifications may be made to the embodiments described here without departing from what is covered by the claims.

Drill jars provide a large transient force impact to a tubing string in either an upward or downward direction. A jar may have an inner mandrel disposed within an outer housing, defining a fluid chamber filled with hydraulic fluid in between the two. The hydraulic fluid may be gas or liquid. A tensile or compressive force is applied, through the tubing string, to either the outer housing or the inner mandrel of the jar, forcing the outer housing and inner mandrel to move relative to one another. The relative movement between the two is initially restricted within the fluid chamber as the jar is set, such that the energy of the tensile or compressive force builds up in the tubing string. As soon as the outer housing and inner mandrel move far enough relative to one another to release, the energy built up in the tubing string is transferred into rapid relative motion between the inner mandrel and the outer housing. Jarring shoulders on both the inner mandrel and outer housing then impact one another, releasing a large amount of kinetic energy into the tubing string and causing a striking blow to the stuck object.

Figure 2:
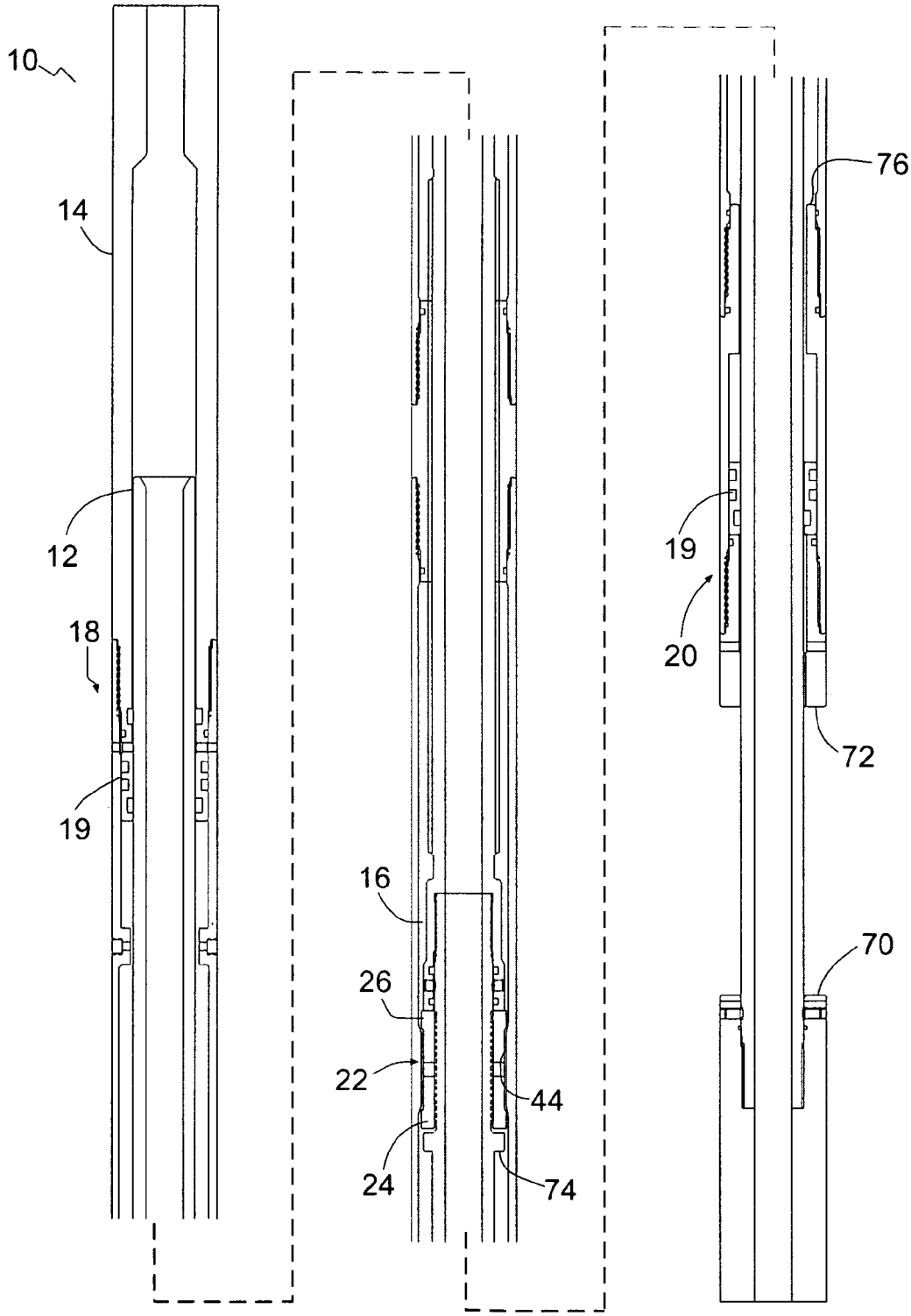
FIG. 2 forms an exploded side elevation view, in section and not to scale, of a double-acting jar in the neutral position.

Referring to FIG. 2, a double-acting jar 10 illustrated, comprising an inner mandrel 12 and an outer housing 14. Inner mandrel 12 is at least partially disposed telescopically within outer housing 14 to define a fluid chamber 16 between inner mandrel 12 and outer housing 14. Fluid chamber 16 contains fluid and is sealed at for example an uphole 18 end and a downhole end 20.

Figures 1A, 1B, 1C, 1D:
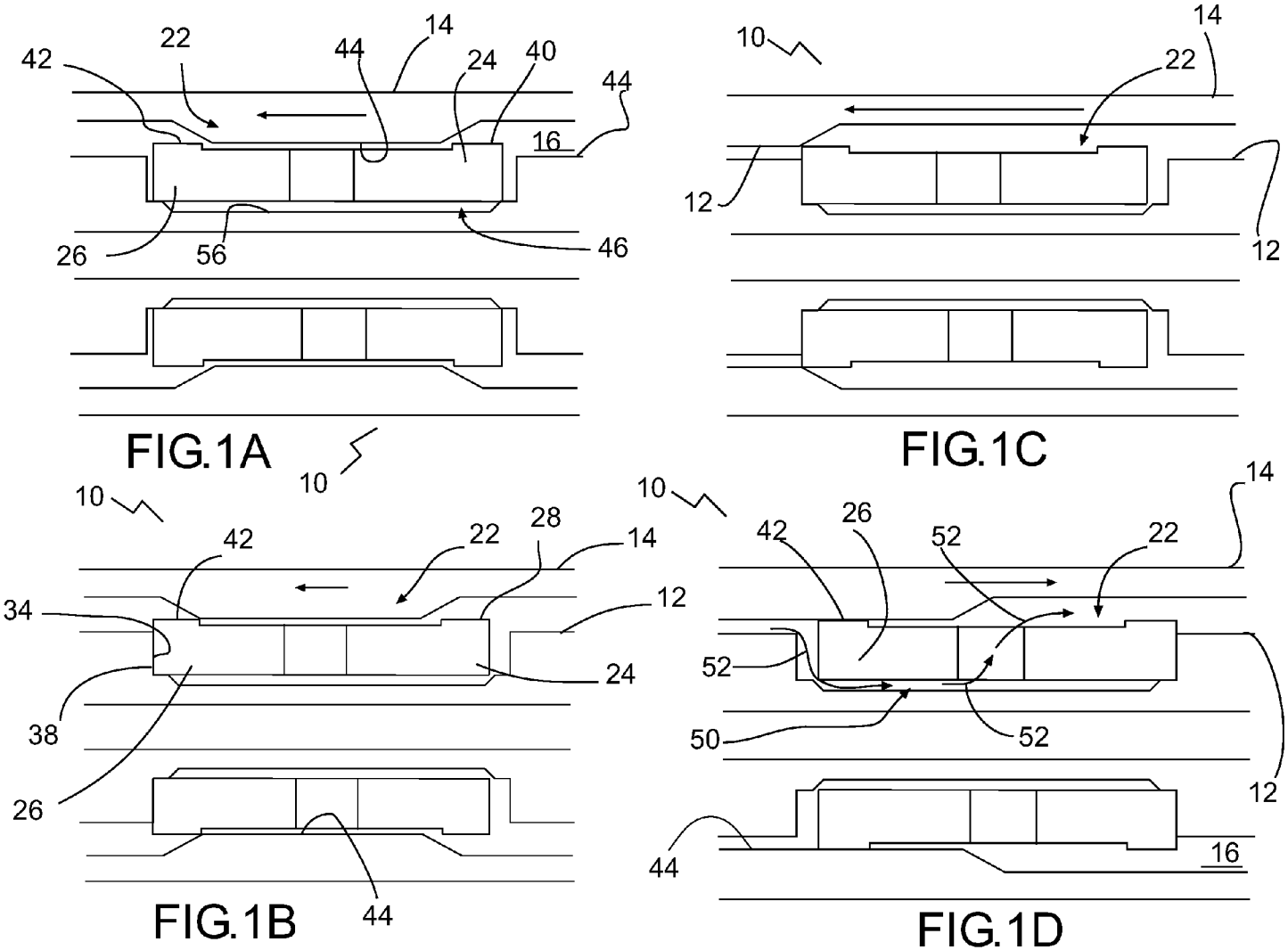
FIGS. 1A-1H are partial side elevation views, in section and not to scale, illustrating the operation of one embodiment of a double-acting jar performing succeeding jars in both directions.

Referring to FIGS. 1A and 2, a valve 22 is disposed within the fluid chamber 16 on one of the inner mandrel 12 and the outer housing 14, in this case the inner mandrel 12 as shown. The valve 22 has a downhole portion 24, and an uphole portion 26, for example as shown. Portions 24 and 26 may be provided as part of the same valve as shown.

Figure 1E:
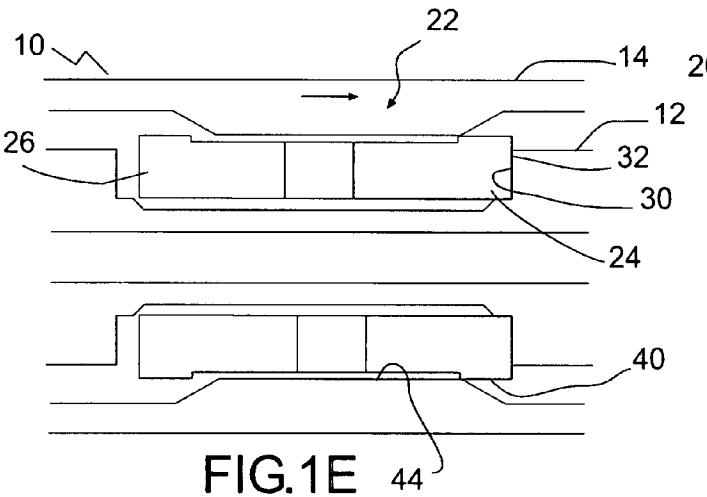

Referring to FIGS. 1A, 1B, and 1E, downhole portion 24 is movable between a downhole seated position (shown in FIG. 1E) in which the valve 22 seats against the one of the inner mandrel 12 and the outer housing 14 the valve is positioned on, and an unseated position (shown in FIGS. 1A and 1B). Referring to FIGS. 1A, 1B, and 1E, uphole portion 26 is movable between an uphole seated position (shown in FIG. 1B) in which the valve 22 seats against the one of the inner mandrel 12 and the outer housing 14 that the valve is positioned on, and an unseated position (shown in FIGS. 1A and 1D).

Figure 11:
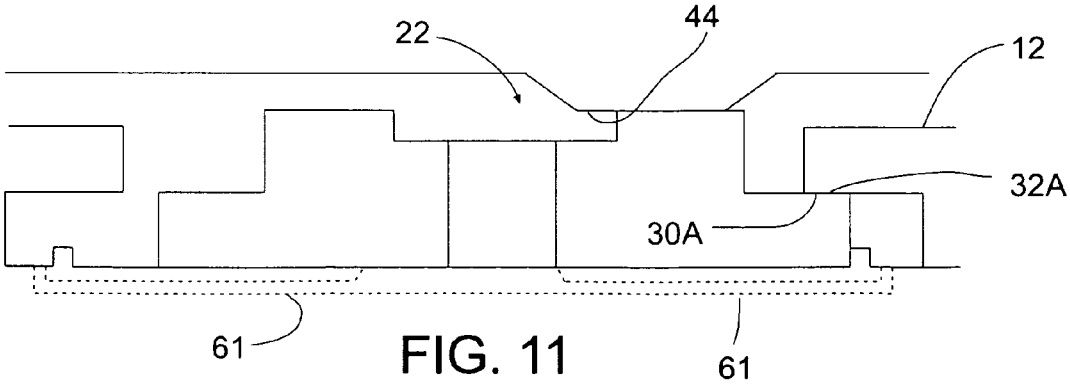
FIG. 11 is a partial side elevation view, in section and not to scale, of an embodiment a valve in the seated position.

Referring to FIG. 1E, jar 10 may use a suitable seating configuration for seating downhole portion 24 and uphole portion 26, for example engagement between an uphole facing seating shoulder 30, and a seating surface 32 of the downhole portion 24. Referring to FIG. 1B, an analogous configuration is illustrated for uphole portion 26, with engagement between a downhole facing seating shoulder 34 and a seating surface 38 of the uphole portion 26. Referring to FIG. 11, other seating configurations are possible, for example between a lateral seating surface 32A of valve 22, and a corresponding lateral seating shoulder 30A as the valve 22 slides into the seated position.

Referring to FIG. 1A, downhole portion 24 has a downhole restriction surface 40, and uphole portion 26 has an uphole restriction surface 42. The other of the outer housing 14 and the inner mandrel 12, in this case outer housing 14, has a cooperating restriction surface 44 that cooperates with the uphole restriction surface 42 and the downhole restriction surface 40 to set the double-acting jar 10 for a jar. Setting the jar causes energy in the drill string to build up for jarring release.

Figure 1G:
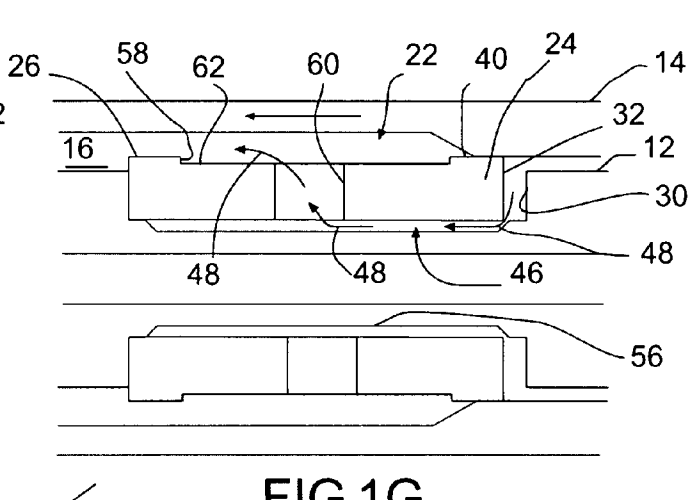
Figure 1F:
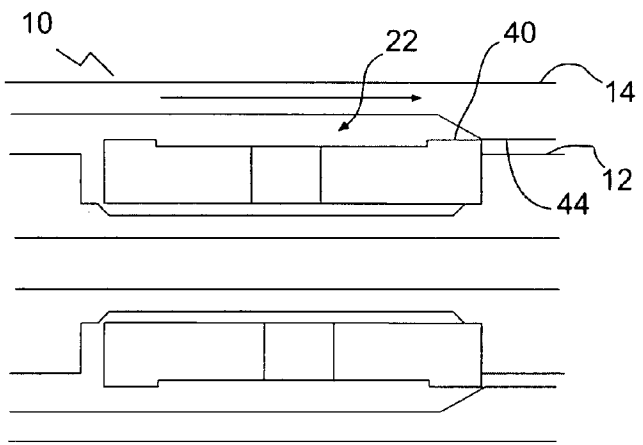
Figure 10:
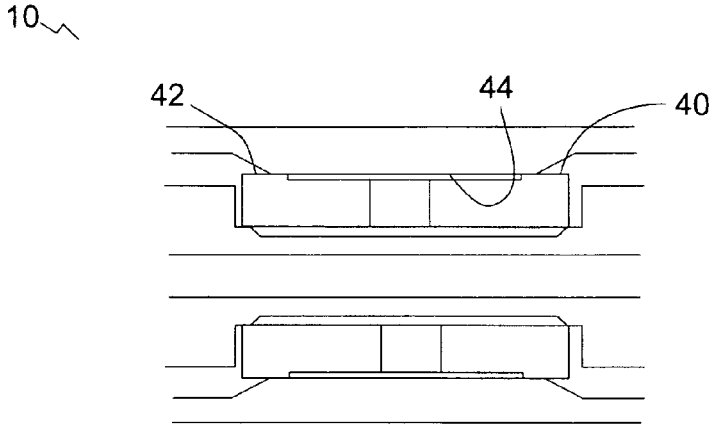
FIG. 10 is a partial side elevation view, in section and not to scale, of an embodiment of a double-acting jar with a cooperating restriction that overlaps the uphole and downhole restriction surfaces in the neutral position.

Referring to FIGS. 1C, 1F, and 1A, the cooperating restriction surface 44 is dimensioned so that, from relative movement of the inner mandrel 12 and the outer housing 14, the cooperating restriction surface 44 is movable from above (shown in FIG. 1C) to below (shown in FIG. 1F) the valve 22. Restriction surface 44 may have a neutral position (shown in FIG. 1A) in which a portion of the cooperating restriction surface 44 is between the downhole restriction surface 40 and the uphole restriction surface 42. Referring to FIGS. 1A and 10, the restriction surface 44 may be fully between (shown in FIG. 1A) or partially between (shown in FIG. 10) the downhole restriction surface 40 and the uphole restriction surface 42 when in the neutral position.

Referring to FIG. 2, restriction surface 44 is spaced from uphole end 18 and downhole end 20 of fluid chamber 16. In the embodiment illustrated in FIG. 2, restriction surface 44 is located on outer housing 14, with valve 22 on inner mandrel 12, although this orientation may be reversed. For example, cooperating restriction surface 44 may be on the inner mandrel 12, with valve 22 positioned on outer housing 14. Cooperating restriction surface 44 may be, for example, a shoulder, such as an annular shoulder. Restriction surface 44 may be of a suitable length for sufficiently setting valve 22 for a jar in either direction.

Referring to FIG. 1G, jar 10, for example the downhole restriction surface 40, incorporates a first bypass 46 that is configured to allow bypass of fluid in the chamber 16, for example in the direction of flow lines 48, when the downhole restriction surface 40 and the cooperating restriction surface 44 move past each other during re-setting of the jar 10. Referring to FIG. 1D, jar 10, for example the uphole restriction surface 42, incorporates a second bypass 50 that is configured to allow bypass of fluid in the chamber 16, for example in the direction of flow lines 52, when the uphole restriction surface 42 and the cooperating restriction surface 44 move past each other during re-setting of the jar 10. The first and second bypasses 46 and 50, respectively, prevent the jar from setting while the cooperating restriction surface 44 is making its way back into the neutral position from a downjar or an upjar, respectively. This way, the jar 10 is not limited to performing jars in alternating directions only.

Figure 7A:
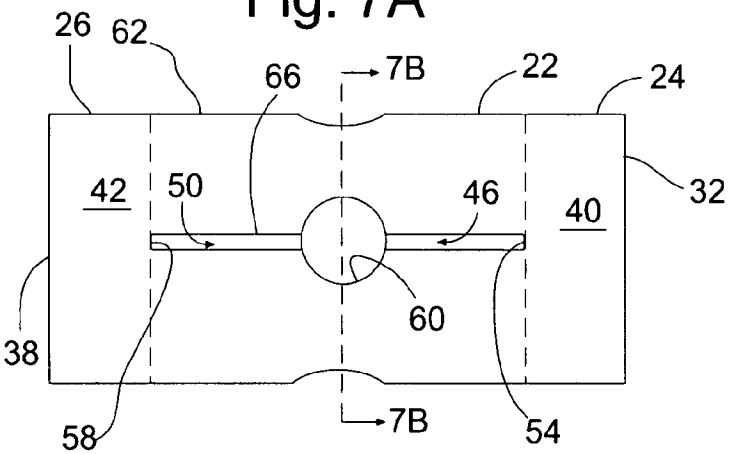
FIGS. 7A and 7B are a plan view, and a section view along the lines 7B in FIG. 7A, respectively, both not to scale, of another embodiment of valve of a double-acting jar.
Figure 7B:
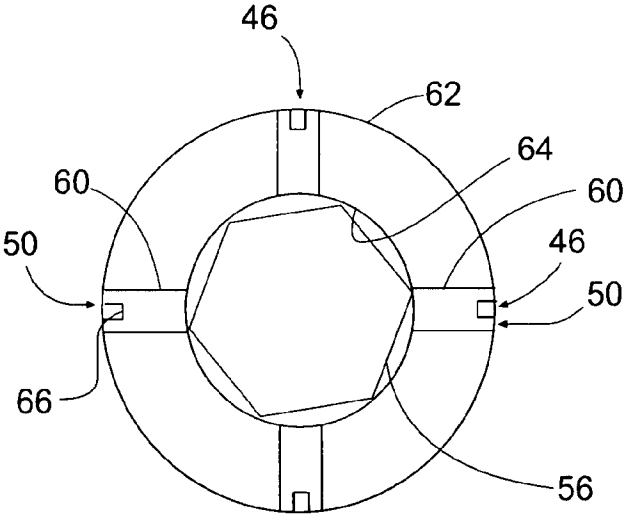

Referring to FIG. 1G, the first bypass 46 may be defined by one or more of the downhole portion 24 and the one of the inner mandrel 12 and the outer housing 14 that the valve is positioned on. Similarly, referring to FIG. 1D the second bypass 50 may be defined by one or more of the uphole portion 26 and the one of the inner mandrel 12 and the outer housing 14 that the valve 22 is positioned on. Referring to FIGS. 7A and 7B, the first bypass 46 may be defined from a downhole end 58 of the uphole restriction surface 42 to seating surface 32 of the downhole portion 24. Similarly, the second bypass may be defined from an uphole end 54 of the downhole restriction surface 44 to seating surface 38 of the uphole portion 26. In some embodiments, one or more of the first bypass 46 and the second bypass 50 comprise a channel 60 that extends between an outer exterior surface 62 to an inner exterior surface 64 of the valve 22. Referring to 7B and 8B, more than one channel 60 may be provided, for example as shown.

Figure 8A:
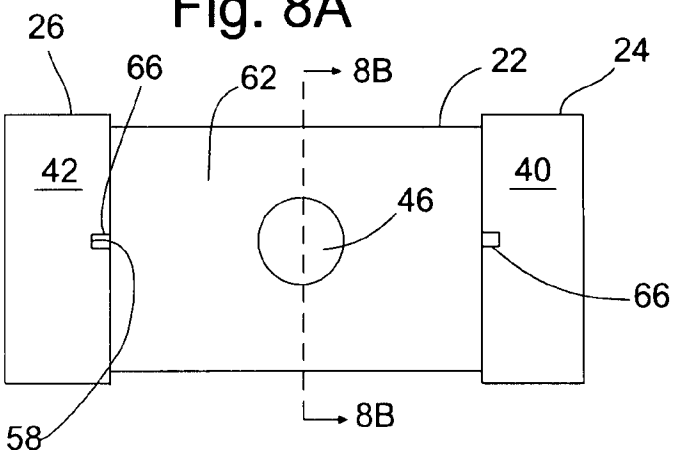
FIGS. 8A and 8B are a plan view and a section view along the lines 8B in FIG. 8A, respectively, both not to scale, of another embodiment of a valve of a double-acting jar.
Figure 8B:
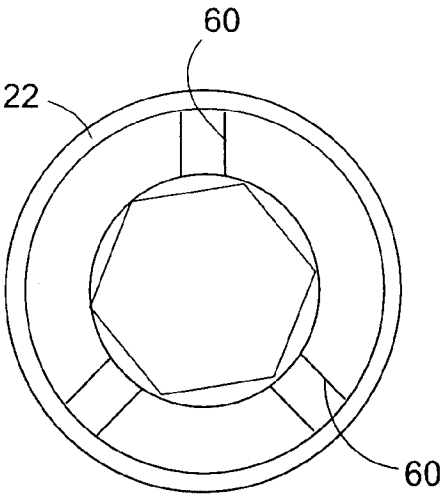

Referring to FIGS. 7A and 7B, the first and second bypasses may effectively form flow passages that are exposed and fully defined when the jar is re-setting and the respective uphole or downhole portion that just carried out a jar is unseated. Referring to FIG. 1G, in the embodiment shown the first bypass 46 is defined by seating surface 32, seating shoulder 30, an undercut portion 56 of inner mandrel 12, passage 60, intermediate outer exterior surface 62, and downhole end 58 of uphole restriction surface 26. Referring to FIG. 7B, undercut portion 56 may be defined by a series of flats on the outer surface of inner mandrel 12 as shown. The purpose of undercut portion 56 may be achieved other ways, such as by defining a channel on exterior surface 64 of valve 22 or as a channel 61 (shown in FIG. 11) within inner mandrel 12 or valve 22. Referring to FIG. 7B, in other embodiments the first bypass may be defined similarly, with the exception that instead of intermediate outer exterior surface 62 the first bypass is defined further by a passage 66 in intermediate outer exterior surface 62 to downhole end 58. Passage 66 may be one or more of a reduced thickness section for example, a reduced or increased diameter section, a tapered section, and a slot. Passage 66 is illustrated in FIG. 7B as a slot. Passage 66 is advantageous because intermediate outer exterior surface 62 can fit closely to restriction surface 44, all they way to uphole restriction surface 42, while still allowing fluid bypass to downhole end 58. This means that, by the time restriction surface 44 reaches uphole restriction surface 42, uphole restriction surface 42 is already aligned properly for entering cooperating restriction surface 44. This reduces the chances of valve 22 jamming upon attempted setting. Referring to FIG. 8A, an embodiment is illustrated where intermediate outer exterior surface 62 comprises a reduced diameter surface relative to uphole restriction surface 42. In this embodiment, passage 66 may still be provided as shown to aid in alignment. It should be understood that second bypass 50 may have the same corresponding characteristics as all embodiments of first bypass 46. Also, plural bypasses may be present.

Figure 6:
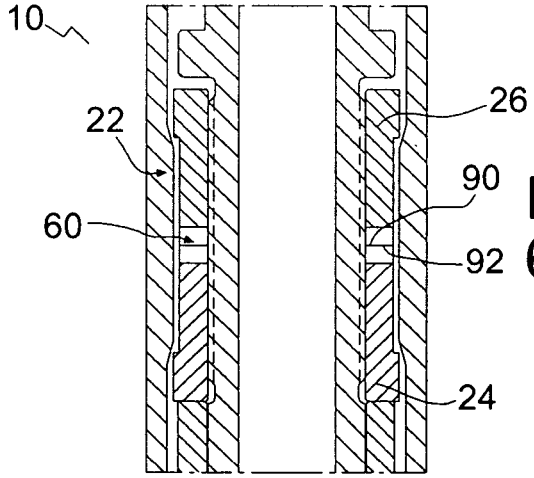
FIG. 6 is a partial side elevation view, in section and not to scale, of an embodiment of a double-acting jar with the valve as a pair of valves.
Figure 9:
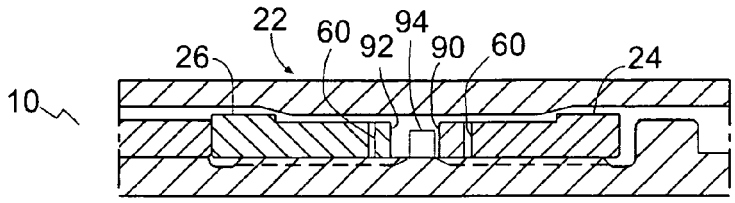
FIG. 9 is a partial side elevation view, in section and not to scale, of an embodiment of a double-acting jar with the valve as a pair of valves.

Referring to FIG. 6, in some embodiments downhole portion 24 and uphole portion 26 are separate valves. Referring to FIGS. 7A and 8A, exemplary embodiments of this may be envisioned by cutting valve 22 in half along the section lines 7A and 8A, respectively. Referring to FIG. 6, in these embodiments, one or more of an uphole end 90 of downhole portion 24 and a downhole end 92 of uphole portion 26 may define passage 60. Referring to FIG. 9, in some embodiments, each of portions 24 and 26 may define a respective passage 60, one or more of passages 60 being laterally spaced from respective ends 90, or 92, as shown. FIG. 9 also illustrates an embodiment where a retaining shoulder 94 separates portions 24 and 26.

Figure 3:
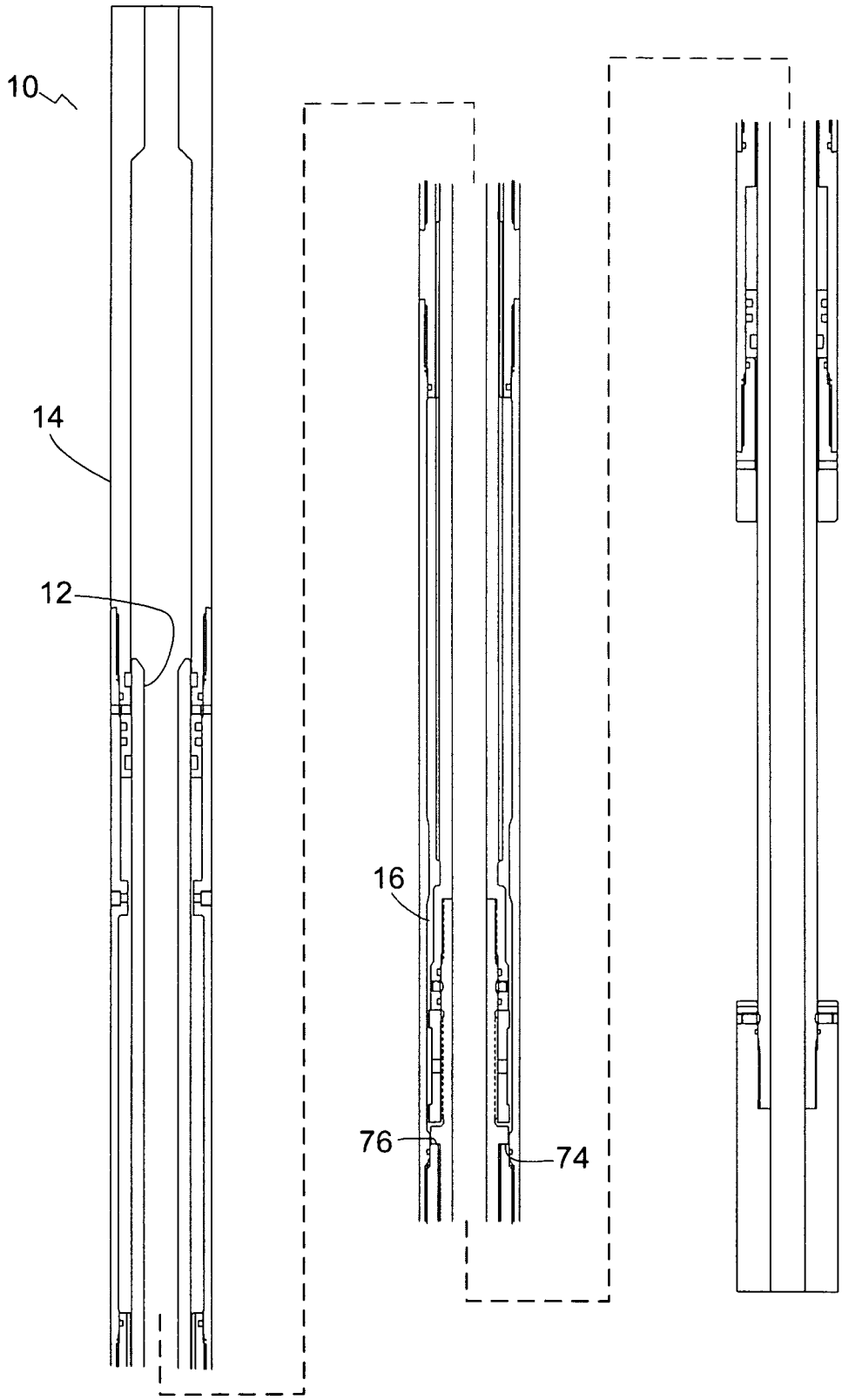
FIG. 3 forms an exploded side elevation view, in section and not to scale, of the double-acting jar of FIG. 2 jarred fully up.
Figure 4:
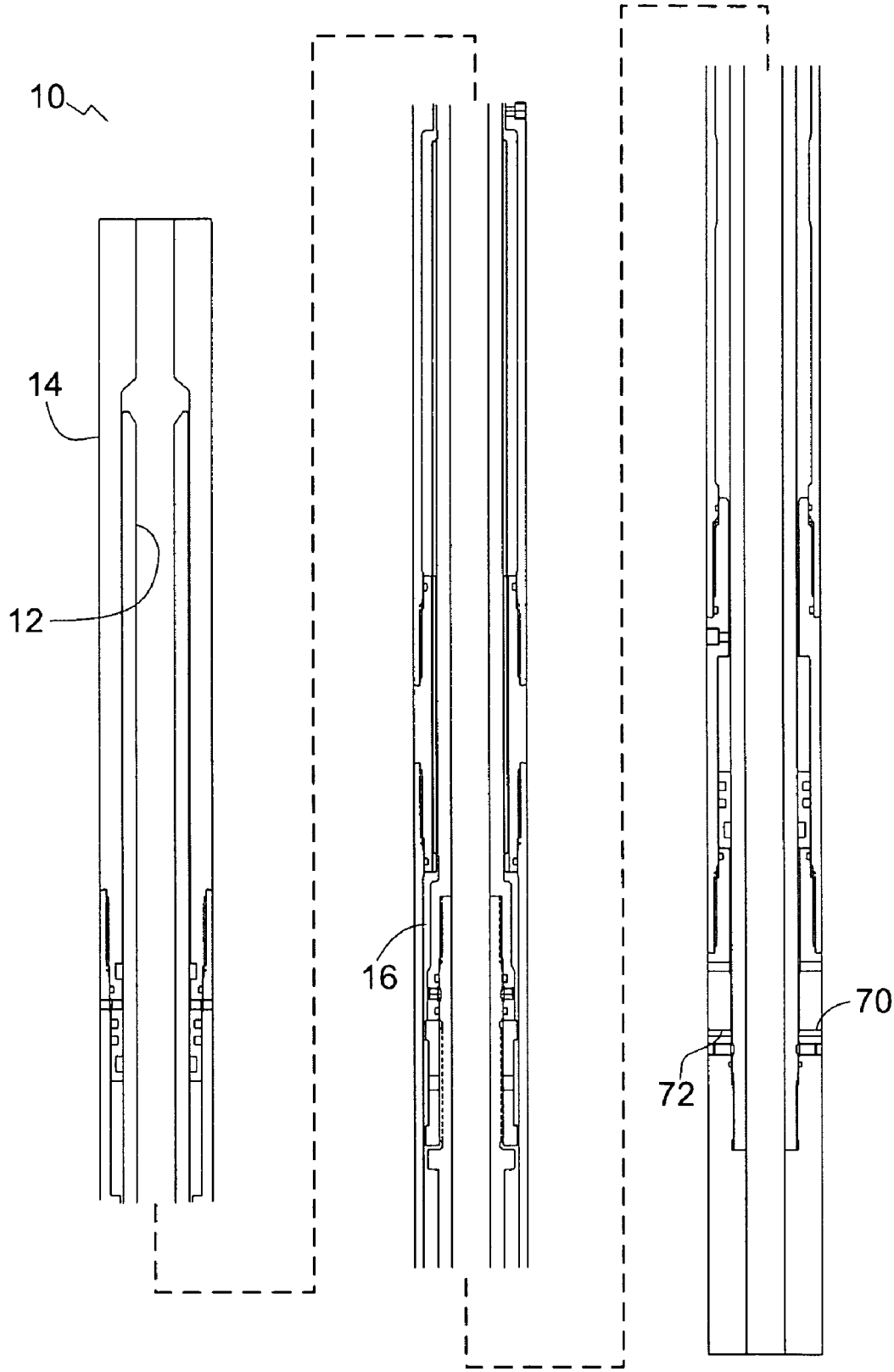
FIG. 4 forms an exploded side elevation view, in section and not to scale, of the double-acting jar of FIG. 2 jarred fully down.

Referring to FIGS. 2 and 4, jar 10 has first jarring surfaces 70 and 72 on inner mandrel 12 and outer housing 14, respectively, for jarring contact with each other during a jar in a downhole direction. A downjar stroke is illustrated from FIG. 2 to FIG. 4. Referring to FIGS. 2 and 3, jar 10 has second jarring surfaces 74 and 76 on inner mandrel 12 and outer housing 14, respectively, for jarring contact with each other during a jar in an uphole direction. An upjar stroke is illustrated from FIG. 2 to FIG. 3. It should be understood that first jarring surfaces 70 and 72, and second jarring surfaces 74 and 76 may be formed at a suitable location on jar 10, such that they are able to collide with one another to release the force of the jarring motion in a striking impact. The jarring surfaces may be positioned within or outside of fluid chamber 16.

It should be understood that limited fluid transfer should occur across the valve 22 in order for restriction surface 44 to be able to move across the seated portion 24 or 26 during setting of the jar, unless the fluid in chamber 16 is compressible to a sufficient extent. Referring to FIG. 5B, one or more of the downhole portion 24, the inner mandrel 12, and the outer housing 14 may at least partially define a first metered bypass 96 that is configured to allow metered bypass of fluid in the chamber 16 when the restriction surface 44 cooperates with the downhole restriction surface 40 to set the double-acting jar 10 for a jar. Similarly, one or more of the uphole portion 26, the inner mandrel 12, and the outer housing 14 may at least partially define a second metered bypass 98 that is configured to allow metered bypass of fluid in the chamber 16 when the restriction surface 44 cooperates with the uphole restriction surface 42 to set the double-acting jar 10 for a jar.

Referring to FIGS. 1E, 5A-5C, one or both of the first metered bypass 96 and the second metered bypass 98 may comprise one or more of a calibrated orifice 100 (shown in FIG. 5B) a calibrated pin 102 in orifice (shown in FIG. 5A), a calibrated grooved pin 106 in orifice (shown in FIG. 5C), a metering groove (not shown), and a close tolerance fit between the restriction surface 44 and one or more of the uphole and downhole restriction surfaces 40 and 42, respectively (shown in FIG. 1E). Referring to FIG. 5B, the first and second metered bypasses 96 and 98, respectively are defined by valve 22, and comprise viscojets. Viscojets comprise calibrated orifices 100, and may contain a one-way check valve 99.

Figure 5A:
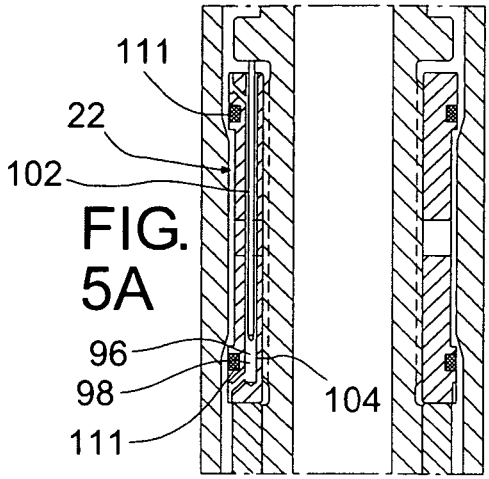
FIGS. 5A-5D are partial side elevation views, in section and not to scale, of different embodiments of double-acting jars in the neutral position, each jar incorporating different metered bypass systems.
Figure 5C:
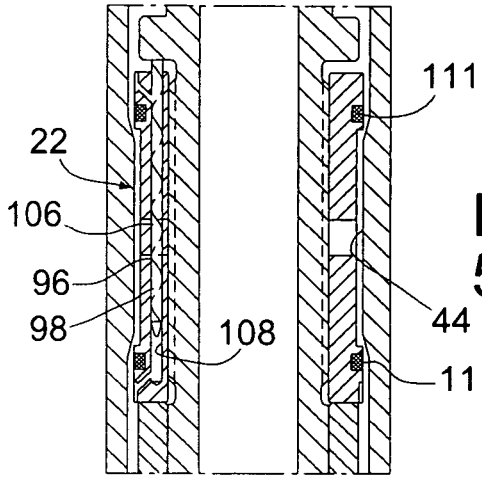
Figure 5B:
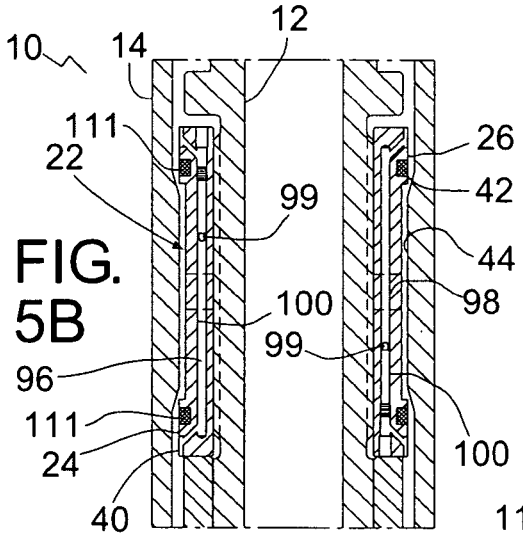
Figure 5D:
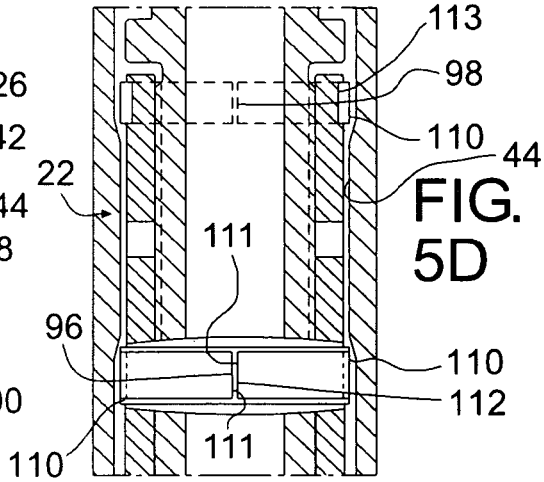

Referring to FIG. 5A, a calibrated pin 102 is fitted in an orifice 104. The pin 102 is calibrated to allow a desired metering rate of fluid through orifice 104. Referring to FIG. 5C, a calibrated grooved pin 106, with for example having a spiral groove much like a screw, is positioned through an orifice 108. Calibration refers to the dimensions being tailored to allow a desired metering rate of fluid when a pressure differential is present. A metering groove may be positioned at a suitable location, for example on one or more of restriction surface 44, surfaces 42 and surface 40, to allow a desired rate of fluid to be metered. Grooves of this kind include spiral grooves. A close tolerance fit refers to surfaces 40 and 42 being machined to fit with restriction surface 44 with a close tolerance that allows fluid to meter across the valve 22 through the annular gap between restriction surface 44 and the set one of surfaces 40 and 42 during build-up of the pressure differential. Sufficient metering bypasses may also be accomplished in other suitable ways. Referring to FIG. 5D, one or both of the first metered bypass 96 and the second metered bypass 98 may comprise a gap 112 defined by a piston ring 110. One or more piston rings 110 may be positioned on one or more of the cooperating restriction surface 44, the downhole restriction surface 40, and the uphole restriction surface 42 to achieve this effect. One or more of surfaces 40, 42, and 44 may be defined by one or more piston rings. Each piston ring 110 defines a gap 112, such as a calibrated gap, between the ends 111 of the piston ring 110 to facilitate metering of fluid. The piston ring may be set in place in a corresponding groove 113, for example in the valve 22 as shown.

Referring to FIG. 5A, in some embodiments metered bypasses 96 and 98 are connected, forming a collective metered bypass. This may be advantageous in that it may require less parts to construct than a system with two distinct metered bypasses. Referring to FIGS. 5A-C, in embodiments where the metering bypasses do not include a close tolerance fit, the restriction surface 44 and surfaces 40, 42 may effectively seal, for example using O-rings 111 or a positive seal fit.

Referring to FIGS. 1A-1H, operation of jar 10 during a sequence of an upjar and then a downjar is illustrated. Referring to FIG. 2, the entire jar 10 is illustrated with valve 22 in the neutral position. Referring to FIG. 1A, outer housing 14 slid from neutral in an uphole direction relative to inner mandrel 12. Referring to FIG. 1B, as soon as restriction surface 44 moves over an initial portion of uphole restriction surface 42 to bias the uphole portion 26 into the uphole seated position, the jar 10 is set for an upjar and the fluid pressure differential is established across valve 22. The pressure differential restricts the upward relative motion of outer housing 14 over inner mandrel 12 as restriction surface 44 moves over uphole restriction surface 42, storing potential energy in the drill string. Referring to FIG. 1C, when restriction surface 44 clears uphole restriction surface 42, the stored energy is suddenly released and transferred into rapid relative motion of outer housing 14 over inner mandrel 12. Referring to FIG. 3, the rapid motion of outer housing 14 relative to inner mandrel 12 is abruptly halted upon colliding impact between second jarring surfaces 74 and 76 as shown, delivering an upward jarring impact.

Referring to FIG. 1D, jar 10 is then re-set, by relative movement of outer housing 14 in the downhole direction. When restriction surface 44 reaches and moves across uphole restriction surface 42, second bypass 50 allows fluid bypass to occur across the valve 22, preventing build up of the fluid pressure differential. Referring to FIG. 1E, this allows restriction surface 44 to return to the neutral position, from which an upjar or a downjar may be carried out as desired.

Referring to FIG. 1E, in this case a downjar is desired to be carried out. Thus, outer housing 14 is slid from neutral in a downhole direction relative to inner mandrel 12. As soon as restriction surface 44 moves over an initial portion of downhole restriction surface 40 to bias the downhole portion 24 into the downhole seated position, the jar 10 is set for a downjar and the fluid pressure differential is established across valve 22. The pressure differential restricts the downward relative motion of outer housing 14 over inner mandrel 12 as restriction surface 44 moves over downhole restriction surface 40, storing potential energy in the drill string. Referring to FIG. 1F, when restriction surface 44 clears downhole restriction surface 40, the stored energy is suddenly released and transferred into rapid relative motion of outer housing 14 over inner mandrel 12. Referring to FIG. 4, the rapid motion of outer housing 14 relative to inner mandrel 12 is abruptly halted upon colliding impact between first jarring surfaces 70 and 72 as shown, delivering a downward jarring impact.

Figure 1H:
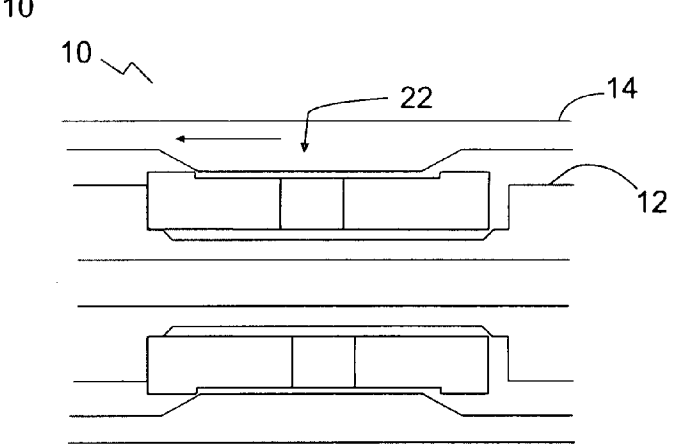

Referring to FIG. 1G, jar 10 is then re-set, by relative movement of outer housing 14 in the uphole direction. When restriction surface 44 reaches and moves across downhole restriction surface 40, first bypass 46 allows fluid bypass to occur across the valve 22, preventing build up of the fluid pressure differential. Referring to FIG. 1H, this allows restriction surface 44 to return to the neutral position, from which an upjar or a downjar may be carried out as desired.

Figure 12:
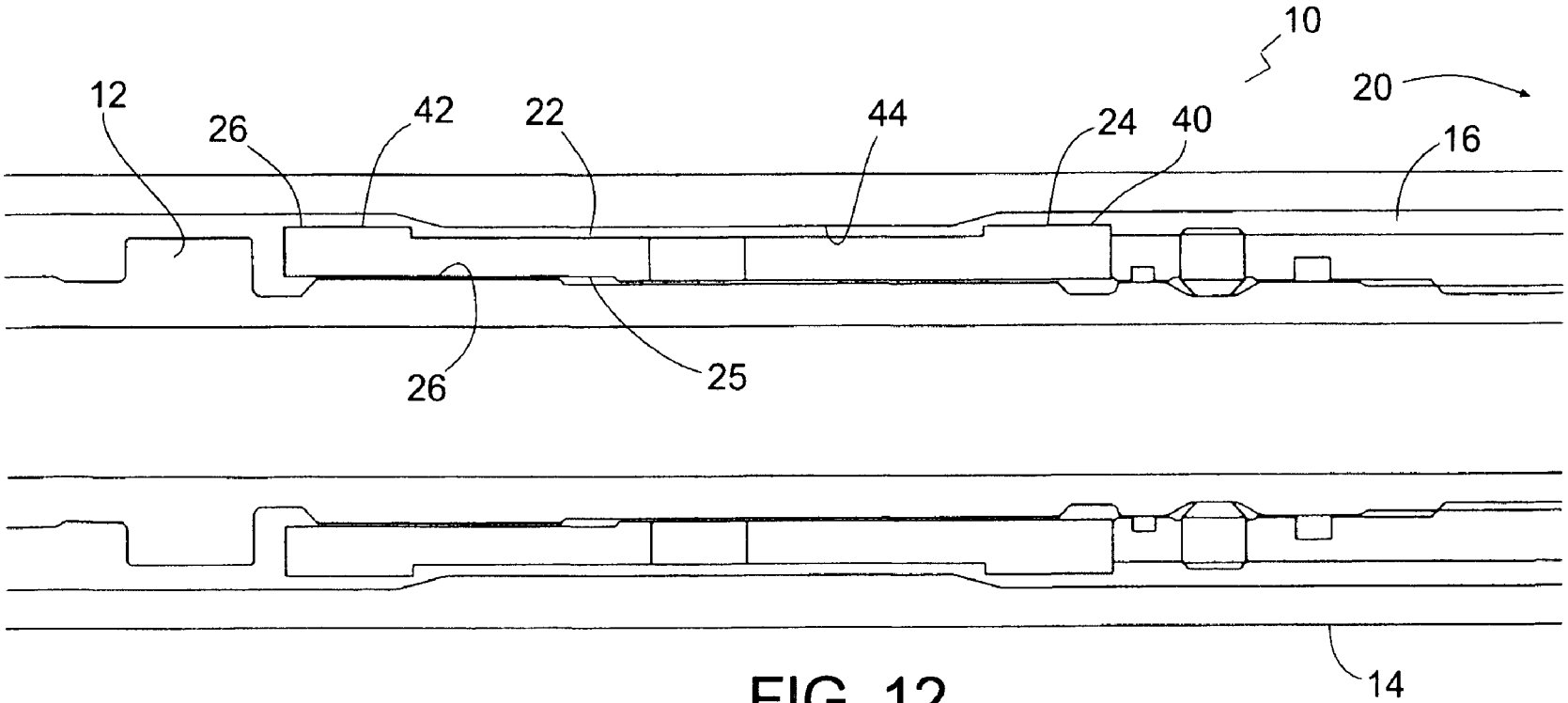
FIG. 12 is a partial side elevation view, in section and not to scale, of a further valve of a double-acting jar.

In some embodiments, the valve 22 may be configured so that less energy is required to jar in one direction than in the other direction. For example, the clearance between the downhole restriction surface 40 and the cooperating restriction surface 44 may be greater than the clearance between the uphole restriction surface 42 and the cooperating restriction surface 44, so that a downjar requires less weight on the drill string to carry out. This may be advantageous, particularly in coiled tubing applications where the compressive strength of the drill string is limited relative to the tensile strength of the drill string. Referring to FIG. 12, a valve 22 made according to this embodiment is illustrated. The jar 10 may be adapted with an appropriate mechanism to ensure that valve 22 can only be installed in the proper orientation, namely with downhole portion 24 directed towards downhole end 20 of the fluid chamber 16. An exemplary mechanism of this sort may be achieved by providing a set of orientation-specific corresponding profiles 25 and 26, respectively, on the valve 22 and the one of inner mandrel 12 and outer housing 14 that valve 22 is positioned on. This way, it is impossible to assemble the jar 10 with the valve 22 oriented backwards.

Double-acting jar 10 may be used with a jar enhancing device (not shown), in order to compound the jarring force of jar 10. A jar enhancing device may be connected, for example, either directly or indirectly above jar 10 in the tubing string. Jar enhancers are useful additions with jar 10, for example, during a coiled tubing jarring operation, because they allow additional force to be built up for a jar, without imposing additional strain on the already limited compressive and tensile stress of the tubing string itself.

Jars 10 of the type disclosed herein may be used in, for example, fishing, drilling, coiled tubing, and conventional threaded tubing, operations. The use of up, down, above, below, uphole, downhole, and directional language in this document illustrates relative motions within jar 10, and are not intended to be limited to vertical motions and motions carried out while jar 10 is positioned downhole. It should be understood that jar 10 may be used in any type of well, including, for example, vertical and deviated wells.

Referring to FIG. 2, fluid chamber 16 may comprise a floating seal 19 at at least one of uphole and downhole ends 18 and 20, respectively. Floating seals 19 allow pressure differentials between fluid chamber 16 and outside of jar 10 to equalize, which may prevent a fluid chamber 16 from collapsing under extreme fluid pressures such as those experienced downhole. In some embodiments, valve 22 is annular in shape. Referring to FIG. 9, the valve 22 may not be annular, for example as illustrated by the section view.

Referring to FIG. 2, fluid chamber 16 need not be annular in shape. In some embodiments, there may be one or more fluid chambers 16, each one operating according to the embodiments disclosed herein for jarring operation. Plural valves 22, and plural restriction surfaces 44 may also be employed. Either or both of inner mandrel 12 and outer housing 14 may be individually composed of, for example, one or more units connected together. Each unit may be, for example, threadably connected together as is well known in the art, and as is illustrated in the figures. Outer housing 14 and inner mandrel 12 may be, for example, tubulars. In the embodiment illustrated in FIG. 2, in a downhole application, outer housing 14 may be connected, directly or indirectly, to a tubing string (not shown), whereas inner mandrel 12 would be connected, directly or indirectly, to, for example, a fishing tool (not shown). In some embodiments, this orientation is reversed. It should be understood that jar 10 can be oriented upside down in a well, and still carry out the intended function of the jar. In addition, valve 22 may be positioned on outer housing 14 in the reverse orientation of that shown in the figures.

As indicated above, the double-acting jar disclosed herein may be used with coiled tubing. Jar 10 is advantageous for coiled tubing operations, because it is adapted to deliver powerful jarring blows in repetitive or sequential uphole and downhole directions, within a tool length that is much shorter than other double-acting jars, which incorporate multiple valves and restrictions. In some embodiments, compressible hydraulic fluid may be used.

A suitable alignment mechanism may be used to align one or more of portions 24 and 26 in the jar 10, for example alignment splines (not shown) an engaging exterior surface, for example surfaces 64 or 62 of valve 22.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A double-acting jar comprising:

an outer housing;

an inner mandrel at least partially disposed telescopically within the outer housing to define a fluid chamber between the inner mandrel and the outer housing, the fluid chamber containing fluid and being sealed;

a valve disposed within the fluid chamber on one of the inner mandrel and the outer housing;

the valve having a downhole portion that is movable between a downhole seated position in which the valve seats against the one of the inner mandrel and the outer housing and an unseated position, the downhole portion having a downhole restriction surface;

the valve having an uphole portion that is movable between an uphole seated position in which the valve seats against the one of the inner mandrel and the outer housing and an unseated position, the uphole portion having an uphole restriction surface;

the other of the outer housing and the inner mandrel having a cooperating restriction surface that cooperates with the downhole restriction surface and the uphole restriction surface to set the double-acting jar for a jar, the cooperating restriction surface being dimensioned so that, from relative movement of the inner mandrel and the outer housing, the cooperating restriction surface is movable between above and below the valve with a neutral position in which a portion of the cooperating restriction surface is between the downhole restriction surface and the uphole restriction surface;

the downhole restriction surface incorporating a first bypass that is configured to allow bypass of fluid in the chamber when the downhole restriction surface and the cooperating restriction surface move past each other during re-setting of the jar to the neutral position;

the uphole restriction surface incorporating a second bypass that is configured to allow bypass of fluid in the chamber when the uphole restriction surface and the cooperating restriction surface move past each other during re-setting of the jar to the neutral position;

first jarring surfaces on the inner mandrel and outer housing respectively for jarring contact with each other during a jar in a downhole direction; and second jarring surfaces on the inner mandrel and outer housing respectively for jarring contact with each other during a jar in an uphole direction.

2. The double-acting jar of claim 1 in which one or more of the downhole portion, the inner mandrel, and the outer housing at least partially define a first metered bypass that is configured to allow metered bypass of fluid in the chamber when the cooperating restriction surface cooperates with the downhole restriction surface to set the double-acting jar for a jar.

3. The double-acting jar of claim 1 in which one or more of the uphole portion, the inner mandrel, and the outer housing at least partially define a second metered bypass that is configured to allow metered bypass of fluid in the chamber when the cooperating restriction surface cooperates with the uphole restriction surface to set the double-acting jar for a jar.

4. The double-acting jar of claim 3 in which the first metered bypass is connected to the second metered bypass.

5. The double-acting jar of claim 3 in which one or both of the first metered bypass and the second metered bypass comprises one or more of a viscojet, a calibrated orifice, a calibrated pin in orifice, a calibrated grooved pin in orifice, a metering groove, and a close tolerance fit between the cooperating restriction surface and one or more of the uphole and downhole restriction surfaces.

6. The double-acting jar of claim 3 in which one or both of the first metered bypass and the second metered bypass comprises a gap defined by a piston ring.

7. The double-acting jar of claim 1 in which the downhole portion and the uphole portion are separate valves.

8. The double-acting jar of claim 1 in which the downhole portion and the uphole portion are part of the same valve.

9. The double-acting jar of claim 1 in which, when in the neutral position, the cooperating restriction surface is fully between the downhole restriction surface and the uphole restriction surface.

10. The double-acting jar of claim 1 in which the outer housing comprises the cooperating restriction surface.

11. The double-acting jar of claim 1 in which the valve is annular in shape.

12. The double-acting jar of claim 1 in which the first bypass is defined by one or more of the downhole portion and the one of the inner mandrel and the outer housing.

13. The double-acting jar of claim 12 in which the first bypass is defined from a downhole end of the uphole restriction surface to a seating surface of the downhole portion.

14. The double-acting jar of claim 1 in which the second bypass is defined by one or more of the uphole portion and the one of the inner mandrel and the outer housing.

15. The double-acting jar of claim 14 in which the second bypass is defined from an uphole end of the downhole restriction surface to a seating surface of the uphole portion.

16. The double-acting jar of claim 13 in which one or more of the first bypass and the second bypass comprise a channel that extends between an intermediate outer exterior surface to an inner exterior surface of the valve.

17. The double-acting jar of claim 1 further comprising a floating seal at one or more of an uphole end and a downhole end of the fluid chamber.

18. The double-acting jar of claim 1 used in a fishing operation.

19. The double-acting jar of claim 1 used in a coiled tubing or drill string operation.

* * * * *